US005241767A

United States Patent [19]

Fuda et al.

[11] Patent Number: 5,241,767

[45] Date of Patent: Sep. 7, 1993

[54] CLIP-ON SIGN

[75] Inventors: Peter Fuda; Joe Leto, both of Lansvale, Australia

[73] Assignee: Plannedsigns (NSW) Pty Limited, Lansvale, Australia

[21] Appl. No.: 761,299

[22] Filed: Sep. 17, 1991

[30] Foreign Application Priority Data

Feb. 19, 1991 [AU] Australia ..... PK4686

[51] Int. Cl.[5] ..... G09F 7/02

[52] U.S. Cl. ..... 40/611

[58] Field of Search ..... 40/611, 575, 576, 489, 40/622; 211/175, 87

[56] References Cited

U.S. PATENT DOCUMENTS

| | | | |
|---|---|---|---|
| 698,272 | 4/1902 | Glover | 211/87 X |
| 1,658,937 | 2/1928 | Nelson | 40/611 X |
| 2,111,780 | 3/1938 | Horton | 40/611 |
| 2,588,050 | 3/1952 | Rutherford | 40/611 |
| 2,884,723 | 5/1959 | Horton | 211/87 X |
| 2,913,841 | 11/1959 | Horton | 40/489 |
| 3,202,292 | 8/1965 | Deliso | 211/87 |
| 4,059,914 | 11/1977 | Dobson | 40/611 |
| 4,461,107 | 7/1984 | Grate | 40/611 X |
| 4,521,984 | 6/1985 | Murray | 40/611 |

FOREIGN PATENT DOCUMENTS

| | | | |
|---|---|---|---|
| 255815 | 3/1963 | Australia . | |
| 246577 | 8/1963 | Australia . | |
| 1327200 | 4/1963 | France | 40/611 |

*Primary Examiner*—Kenneth J. Dorner
*Assistant Examiner*—Milton Nelson, Jr.
*Attorney, Agent, or Firm*—Ladas & Parry

[57] ABSTRACT

A clip-in display system comprising a frame having a plurality of parallel cross-members extending across the frame wherein at least two of said cross-members each have at least one slot extending therethrough, the or each slot being adapted to engage a tab, and a display piece able to be fitted between said cross-members and having at least one tab at either end, wherein said tabs engage said slots when the display piece is fitted between the cross-members of the frame.

5 Claims, 2 Drawing Sheets

CLIP-ON SIGN

Figure 1:
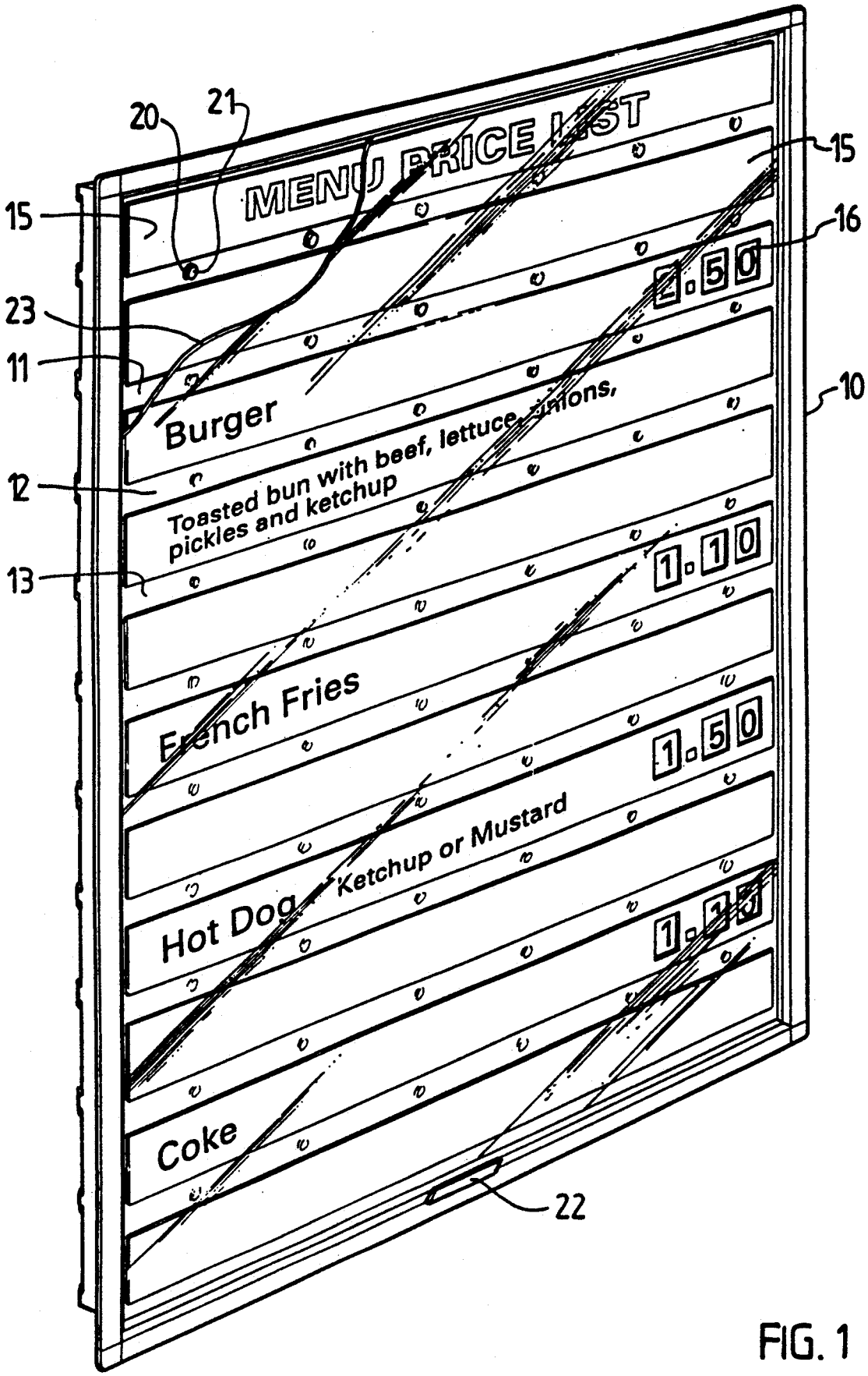

The present invention relates too a clip-in display system and, more particularly, to the use of such a system to display prices on a menu board.

The price display on a menu board that is on permanent display, such as in fast food outlets, is changed several times a year. For a large chain of fast food outlets, the amount of time spent in changing the display is considerable, so the display system should be designed to make changing the price as simple and as quick as possible. The display must also be durable and able to be kept clean. Preferably, it should be cheap to manufacture and easy to install.

One previously known system is a display where a tape is rolled through a display frame. The tape is held in place under the edges of the frame and can be rolled around to the next number by an operator placing their thumb on the tape and sliding it through the frame. The system is complex and liable to break.

Another system involves shining a light behind a panel that has cut-outs in it. Each cut-out segment has a panel that can be slid across in front of it to block the light. By leaving some panels open and closing others, any number can be created in lights. Thus one creates a lighted display of a price. The drawback of this system are that the panels jam easily and often break, and that the lighted cut-outs do not join together so the shape of the numbers does not appear natural.

A type of clip-in system is known where a rectangular frame is provided with a tab at each end and a flange projecting inward from the edge of the frame around the border of the frame behind the tab. A flexible rectangular sheet carrying a number is clipped into the frame between the tab and the flange. In this system the number is clipped in from the front which means it can get dirty easily and is prone to pop out again if accidentally knocked.

It is an object of the present invention to overcome or ameliorate at least some of the disadvantages of the systems described above.

According to the invention there is provided a clip-in display system comprising a frame having a plurality of parallel cross-members extending across the frame wherein at least two of said cross-members each have at least one slot extending therethrough, the or each slot being adapted to engage a tab, and a display piece able to be fitted between said cross-members and having at least one tab at either end, wherein said tabs engage said slots when the display piece is fitted between the cross-members of the frame.

In a preferred embodiment of the invention the frame is rectangular and comprises a menu board. The cross-members extend horizontally across the frame parallel to the short sides of the rectangle.

In a particularly preferred embodiment there are ten cross-members which, together with the edges of the frame create eleven spaces of suitable size to hold a strip giving the name of a menu item. The strip may be opaque in which case it will need a transparent patches or holes cut in it to allow the price display to be visible. In this embodiment, there is a transparent sheet of perspex, glass of like material covering the board and attached to the sides of the frame.

The cross-members are, in one embodiment, attached to the cover with a double-sided adhesive strip but the adhesives strip is narrower than the cross-member.

Thus, there is a groove between the cross-member and the cover created where the cross-member overhangs the adhesive strip and into which the menu strip can slide and be held in place.

The preferred way of fixing the cross-member to the cover is to drill holes at intervals along the cross-member and fill the holes with a plug made of polymeric material, preferably acrylic, which is coated with adhesive. The plug adheres to the cross-member and the cover, holding them together.

Figure 2:
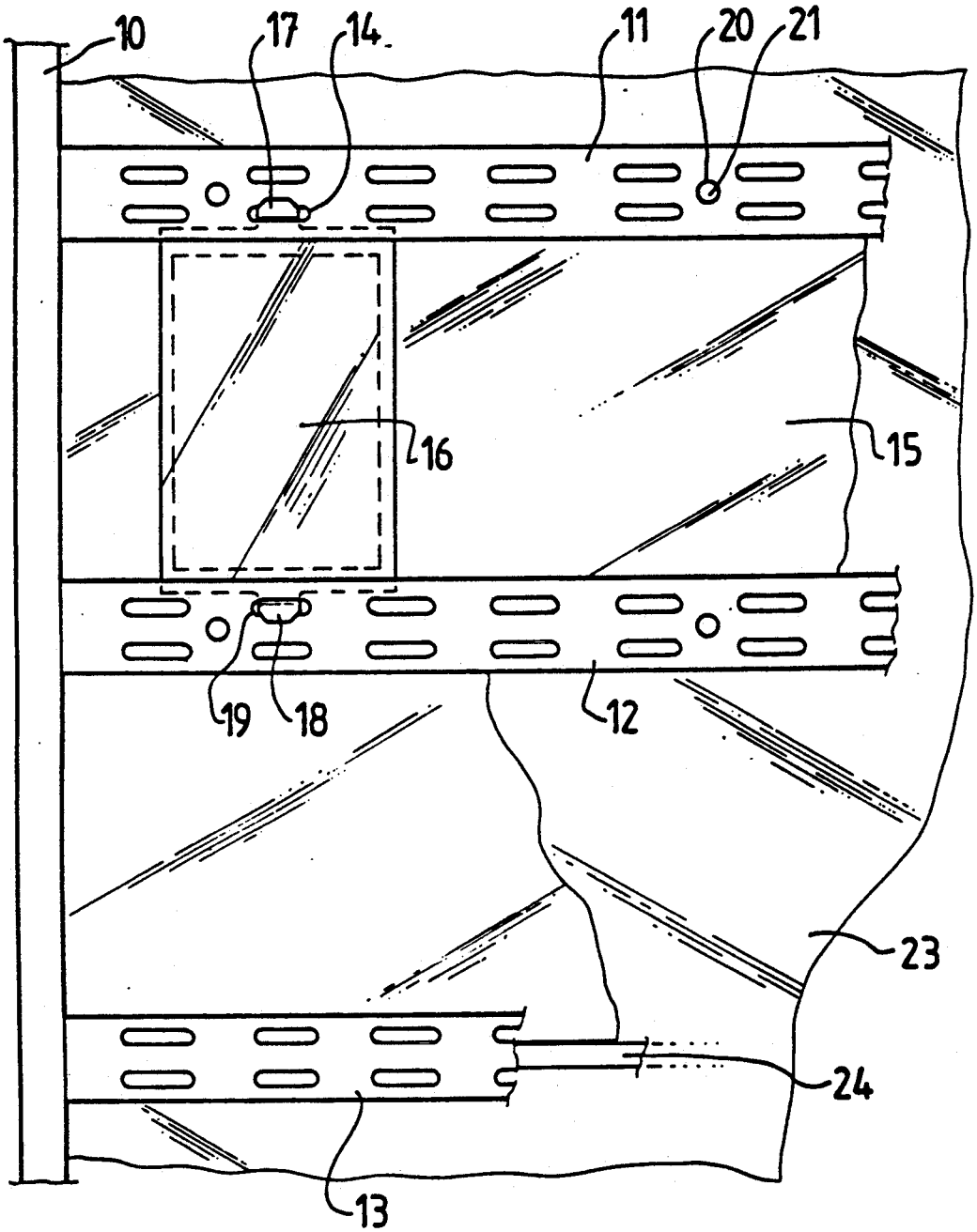

In order that the invention may be more readily understood and put into practical effect, reference will now be made to the accompanying drawings in which:

FIG. 1 is a front view of a menu board in accordance with the present invention, and FIG. 2 is a plan view of the back of part of a menu board according to one embodiment of the invention.

The menu board illustrated in FIG. 1 comprises frame 10 with cross-members such as those designated 11, 12 and 13 running between the two sides of the frame. Opaque strip 15 giving the name of a menu item is positioned between cross-members 11, 12. There are, transparent patches or holes in some strips which allow a display piece 16 displaying a price to be seen through the opaque strip 15. This arrangement is shown in more detail from the back of the sign in FIG. 2. The menu board may have a projection 22 at the bottom of the board for ease of handling.

In FIG. 2 frame side 10 of the menu board can be seen. It is connected to cross-members 11, 12 and 13 which continue on to join the other side of the frame (not shown). Each cross-member contains slots such as slots 14 and 19.

In the particular embodiment shown in FIG. 2 pairs of slots are spaced at regular intervals along each cross-member.

An opaque strip 18 giving the name of a menu item fits into the space between the cross members 11 and 12. Behind the strip 15 and corresponding to a transparent patch or hole in the strip 15 is display piece 16. If designed to display a price this piece has a number printed on the front. In FIG. 2 the display piece is seen from, the back.

A transparent sheet 23, made of perspex, and shown partially cut-away in FIG. 1, covers the front of the menu board. The cover sheet is attached to each cross-member 11 and 12 by means of adhesive-coated acrylic plugs eg. plug 21 that are inserted in holes 20 drilled in each cross-member 11 and 12. The plug adheres to the perspex cover and to the cross-member, holding them together. An alternate arrangement for fixing the sheet 23 to the menu board is shown for cross-member 13 in FIG. 2 where a double-sided adhesive strip 24 is placed between the sheet 23 and cross-member 13, adhering to them both. This arrangement may be used separately for the adhesive-coated acrylic plug arrangement described above, but they are illustrated together in FIG. 2 for convenience.

In order to fit display piece 16 between cross-members 11 and 12 as shown, the display piece 16 is positioned roughly as shown then tab 17 is slid underneath cross-member 11 and up through slot 14 and into the position shown. The operation is repeated to force tab 18 through slot 19 to hold the other end of the display piece. The display piece is held firmly in the position shown displaying a symbol on its front face which may be read from the front of the board. The ends of the display piece are shown in hidden detail to indicate that they are underneath the cross-members.

Although not shown in FIG. 2, the tabs 17 and 18 are usually bent at an angle of between about 15° and 45° above the plane of the display piece to facilitate forcing the tab upwards through the slot.

Various modifications may be made in details of design and construction without departing from the scope and ambit of the invention.

We claim:

1. A clip-in display assembly comprising:

a frame;

a transparent cover connectable to said frame;

at least two cross members to extend across the frame and define an elongate display space between adjacent cross members, the cross members being connectable to the cover and each cross member has at least one slot defined therein that is aligned with a corresponding slot on an adjacent cross member;

a display strip insertable into the display space so to be supported by adjacent cross members, said display strip having indicia thereon and having at least one transparent portion; and at least one display piece removably attached to rear portions of adjacent cross members so that indicia on the display piece is aligned with the transparent portion of the display strip, and wherein the display piece has oppositely extending tabs to engage the corresponding aligned slots so as to removably attach the display piece to adjacent cross members.

2. The clip-in display assembly according claim 1, wherein the cross members have holes defined therein for receiving adhesive-coated acrylic plugs that connect the cross members to the cover.

3. The clip-in display assembly according claim 1, wherein each cross member is connectable to the cover by means of a double-sided adhesive strip.

4. The clip-in display assembly according claim 1, wherein the frame is rectangular.

5. The clip-in display assembly according claim 4, wherein the indicia on the display strip comprises items from a food menu and the indicia on the display piece comprises corresponding price information.

* * * * *